US011076236B2

(12) United States Patent
Daveau et al.

(10) Patent No.: US 11,076,236 B2
(45) Date of Patent: Jul. 27, 2021

(54) ELECTRODYNAMIC LOUDSPEAKER COMPRISING A TRUSS

(71) Applicant: DEVIALET, Paris (FR)

(72) Inventors: Gaël Daveau, La Ville Aux Dames (FR); Sylvain Coutarel, Clermont-Ferrand (FR)

(73) Assignee: DEVIALET, Paris (FR)

( * ) Notice: Subject to any disclaimer, the term of this patent is extended or adjusted under 35 U.S.C. 154(b) by 0 days.

(21) Appl. No.: 16/594,998

(22) Filed: Oct. 7, 2019

(65) Prior Publication Data

US 2020/0112795 A1 Apr. 9, 2020

(30) Foreign Application Priority Data

Oct. 8, 2018 (FR) ..... 18 59322

(51) Int. Cl.

| | |
|---|---|
| ***H04R 9/04*** | (2006.01) |
| ***H04R 9/06*** | (2006.01) |
| ***H04R 1/28*** | (2006.01) |
| ***H04R 7/20*** | (2006.01) |

(52) U.S. Cl.

CPC ..... *H04R 9/06* (2013.01); *H04R 1/2834* (2013.01); *H04R 7/20* (2013.01)

(58) Field of Classification Search

CPC ..... H04R 9/04; H04R 9/041; H04R 9/042; H04R 9/043; H04R 9/045

See application file for complete search history.

(56) References Cited

U.S. PATENT DOCUMENTS

| | | | | |
|---|---|---|---|---|
| 6,672,423 | B2 * | 1/2004 | Kato | H04R 9/043 181/154 |
| 7,970,162 | B2 * | 6/2011 | Sumitani | H04R 9/046 381/407 |
| 8,131,000 | B2 * | 3/2012 | Lin | H04R 9/022 381/397 |
| 9,025,809 | B1 * | 5/2015 | Kallen | H04R 9/06 381/405 |
| 9,467,783 | B2 * | 10/2016 | Bullimore | H04R 9/043 |
| 10,034,094 | B2 * | 7/2018 | Perkins | H04R 9/043 |
| 2010/0195863 | A1 * | 8/2010 | Fujimoto | H04R 9/041 381/409 |
| 2011/0044491 | A1 * | 2/2011 | Ku | H04R 31/006 381/433 |
| 2013/0058521 | A1 * | 3/2013 | Davidson | H04R 7/18 381/398 |

(Continued)

*Primary Examiner* — Ryan Robinson

(74) *Attorney, Agent, or Firm* — B. Aaron Schulman, Esq.; Stites & Harbison, PLLC

(57) ABSTRACT

The electrodynamic loudspeaker (10), comprising:

a fixed frame (12), a motor including a fixed base (14) connected to the fixed frame (12) and a part (16) movable axially relative to the fixed base (14) along an axis (A-A'), a convex membrane (18), the convexity of which is oriented toward the outside of the loudspeaker (10), and a truss (20) connecting the convex membrane (18) and the moving part (16).

The truss (20) comprises an inner ring (46) and an outer ring (48) that are coaxial, connected to one another by radial pillars (50) and a crown (52) for fastening to one end (53) of the moving part (16), the convex membrane (18) being fastened bearing on the inner and outer rings (46, 48).

9 Claims, 6 Drawing Sheets

(56) References Cited

U.S. PATENT DOCUMENTS

| | | | | |
|---|---|---|---|---|
| 2016/0127832 | A1* | 5/2016 | Chou | H04R 7/16<br>381/398 |
| 2017/0171663 | A1* | 6/2017 | Calmel | H04R 9/025 |
| 2020/0221214 | A1* | 7/2020 | Mordechai | H04R 9/06 |

* cited by examiner

ELECTRODYNAMIC LOUDSPEAKER COMPRISING A TRUSS

CROSS-REFERENCE

This claims the benefit of French Patent Application FR 18 59322, filed on Oct. 8, 2018 and hereby incorporated by reference herein.

FIELD OF THE INVENTION

The present invention relates to an electrodynamic loudspeaker, of the type comprising

- a fixed frame,
- a motor including a fixed base connected to the fixed frame and a part movable axially relative to the fixed base along an axis,
- a convex membrane, the convexity of which is oriented toward the outside of the loudspeaker, and
- a truss connecting the convex membrane and the moving part.

BACKGROUND OF THE INVENTION

Such loudspeakers are generally used to produce sounds from an electric signal. It is known that increasing the area of the convex membrane increases the volume of the sounds produced by the loudspeaker.

Loudspeakers are known having a rigid membrane and a dome shape with the convexity turned toward the outside. The dome is fastened to the end of a coil-holder tube along a connecting ring arranged in the median position of the dome.

Such a loudspeaker is not, however, fully satisfactory. When sounds produced by the loudspeaker have a high frequency, for example around 500 Hz, in particular close to 550 Hz, resonance modes can be produced by the membrane. These resonance modes deteriorate the quality of sounds produced by the loudspeaker.

SUMMARY OF THE INVENTION

One aim of the present invention is to propose a loudspeaker capable of producing good quality sounds at high frequencies, even if the membrane has a large area.

To that end, the invention relates to an electrodynamic loudspeaker of the aforementioned type, in which the truss comprises an inner ring and an outer ring that are coaxial, connected to one another by radial pillars and a crown for fastening to one end of the moving part, the convex membrane being fastened bearing on the inner and outer rings.

According to particular embodiments, the loudspeaker comprises one or more of the following features, considered alone or according to any technically possible combinations:

- the convex membrane has a peripheral edge, the outer ring being directly fastened to the peripheral edge of the convex membrane.
- the truss comprises an axial skirt secured to the radial pillars and extending axially opposite the inner and outer rings;
- the fastening crown comprises a groove for receiving the end of the moving part, the moving part advantageously being glued to the receiving groove;
- the truss has first and second front plates, each extending over 180° around the axis, the first front plate of the truss further including at least one conductive strip connecting the moving part to an electrical supply braid, the second front plate of the truss being devoid of such a conductive strip;
- the conductive strip comprises an end lug configured to receive the electrical supply braid;
- the conductive strip is received between two essentially parallel faces of the truss and in that the conductive strip comprises, on an inner face, a protrusion bearing against one of the faces of the truss, the conductive strip bearing on the other truss face along its other face;
- the conductive strip comprises at least one blocking prong configured to penetrate the truss so as to prevent the movement of the conductive strip away from the convex membrane along the direction of the axis of the loudspeaker;
- the radial pillars are angularly distributed and in that the density of radial pillars is greater in the second front plate of the truss than in the first front plate of the truss; and
- the electromagnetic loudspeaker includes a resilient guide ring inserted between the fixed frame and a free end of the axial skirt.

BRIEF DESCRIPTION OF THE DRAWINGS

The invention will be better understood upon reading the following description, provided solely as an example, and done in reference to the appended drawings, in which.

DETAILED DESCRIPTION OF THE INVENTION

In the following description, the expressions "front" and "back" should be understood in reference to the main propagation direction of the sounds from a loudspeaker. The front direction corresponds to the outside of the loudspeaker, and the back direction corresponds to the inside of the loudspeaker.

Figure 1:
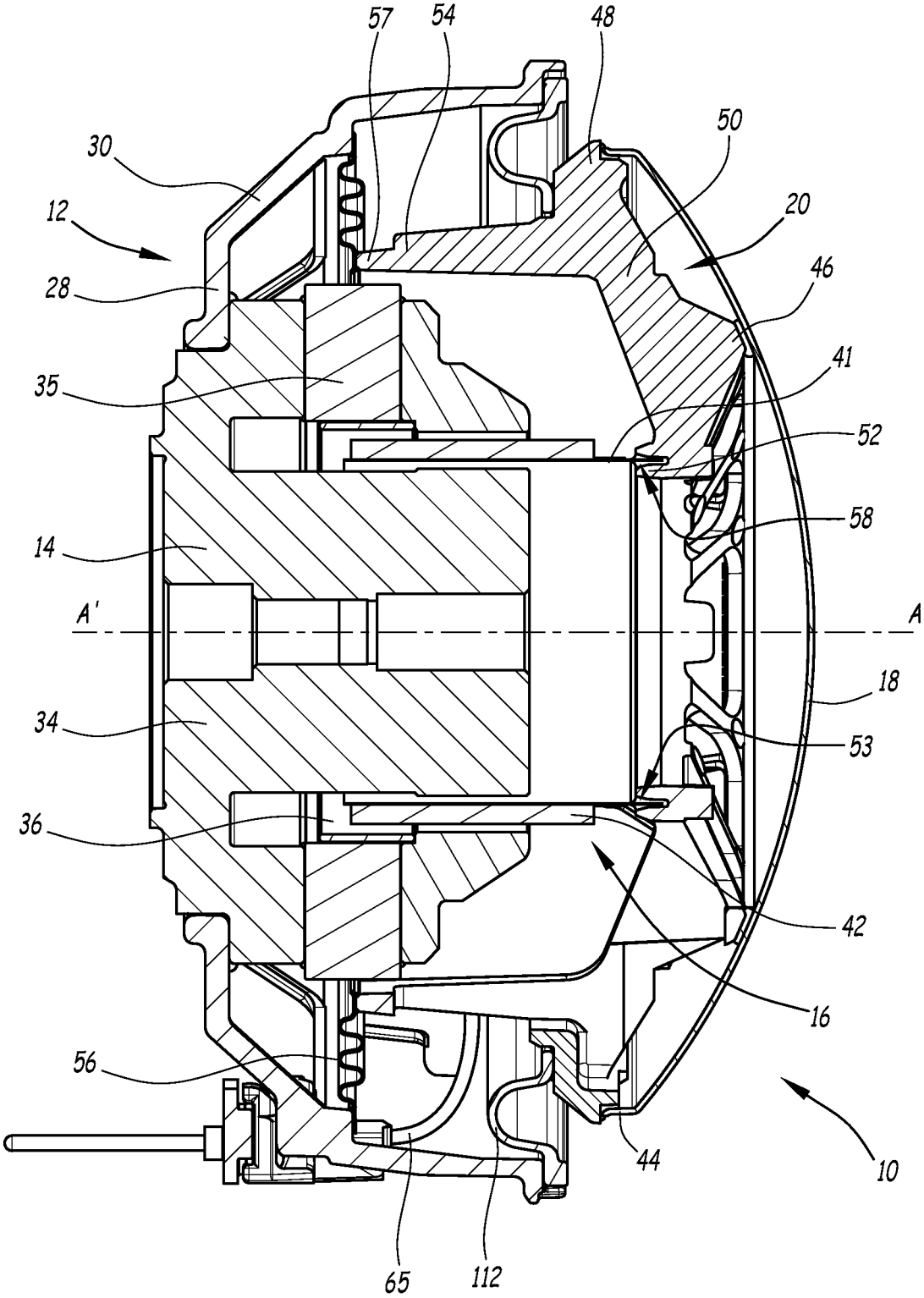
FIG. 1 is a cross-sectional view of a loudspeaker according to the invention, the cross-section being taken along a plane passing through the axis of the loudspeaker.

FIG. 1 illustrates an electrodynamic loudspeaker 10. It is advantageously substantially of revolution around an axis A-A'.

The loudspeaker 10 comprises a fixed frame 12, a motor comprising a fixed base 14 connected to the fixed frame 12 and a moving part 16 movable axially relative to the fixed base 14.

The loudspeaker 10 also comprises a convex membrane 18 and a truss 20 connecting the convex membrane 18 and the moving part 16.

The fixed frame 12 is also referred to as "basket assembly". It comprises a bottom 28 and a circumferential wall 30 connecting the bottom 28.

The circumferential wall 30 has a frustoconical shape with the axis A-A' flared toward the front of the loudspeaker 10.

In the embodiment of the invention shown in the Figures, the fixed base 14 comprises a yoke 34 on which a magnet 35 is arranged. The yoke 34 defines at least one air gap 36.

The moving part 16 comprises a cylindrical coil-holder 41 with axis A-A on the outer surface of which a moving coil 42 is wound.

The moving coil 42 is arranged in the air gap 36.

The moving coil 42 is able to oscillate along the axis A-A' around an equilibrium position shown in the Figures.

In the following description, the "axial" description refers to the direction along the axis A-A', and the "radial" direction refers to a direction perpendicular to the axis A-A'.

The convex membrane 18 has a convexity oriented toward the outside of the speaker 10. The convex membrane 18 has a spherical cap or dome shape.

The convex membrane 18 has a peripheral edge 44. The peripheral edge 44 has a substantially circular shape centered on the axis A-A'.

Figure 2:
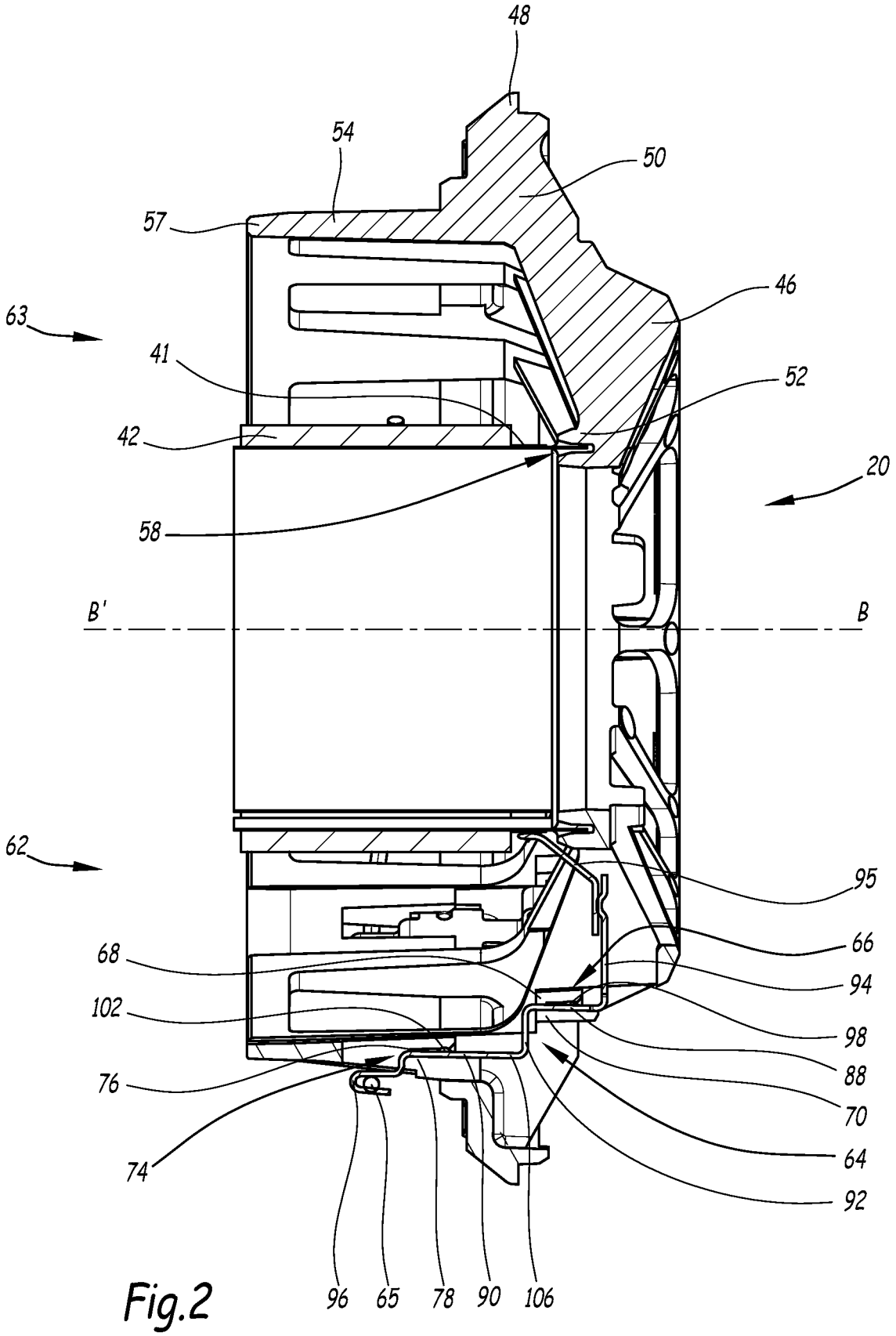
FIG. 2 is a cross-sectional view of the loudspeaker shown in FIG. 1 without the convex membrane and the fixed frame.
Figure 3:
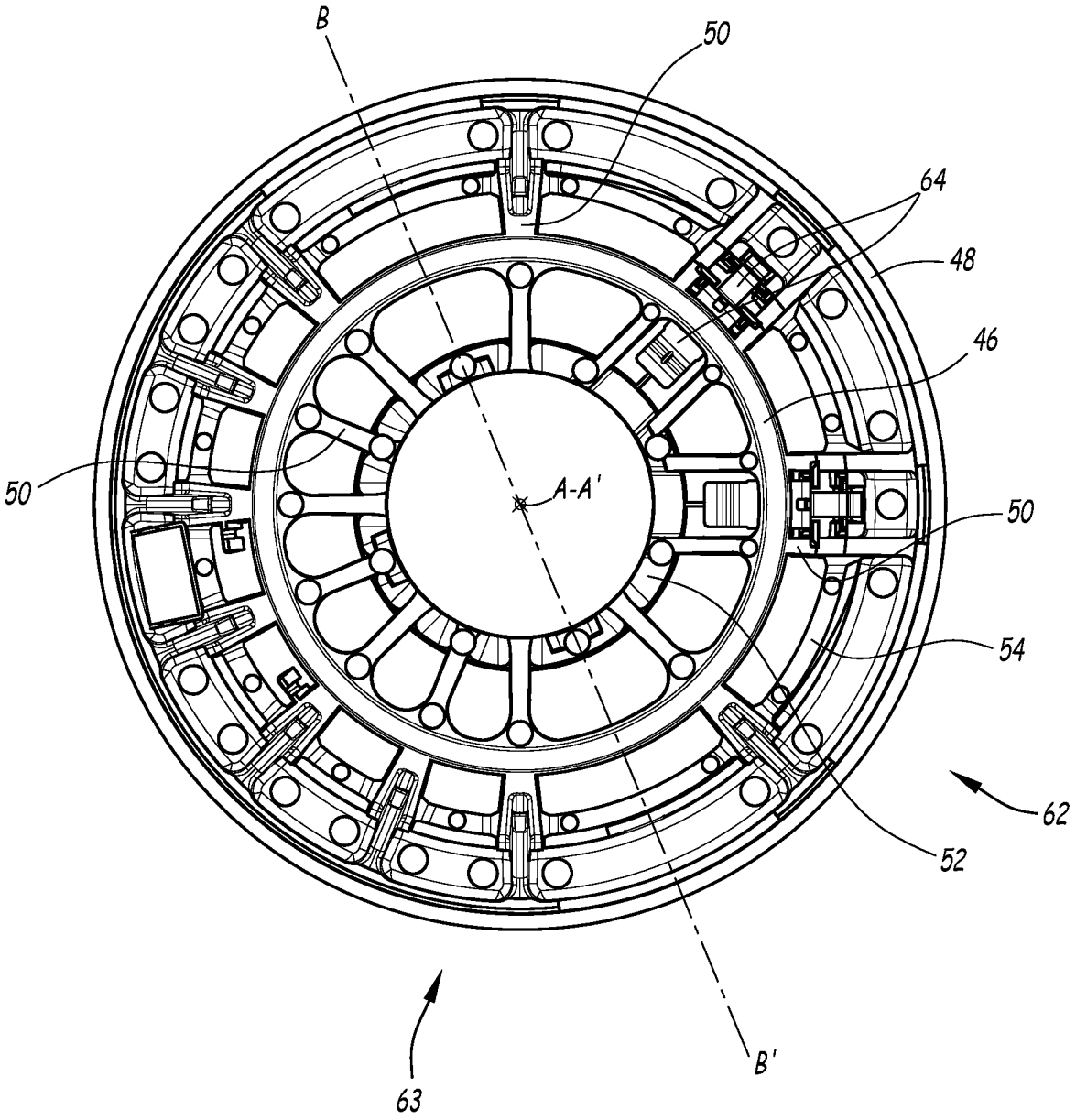
FIG. 3 is a top view of a truss of the loudspeaker according to the invention.

In reference to FIGS. 1 to 2, the truss 20 generally has axis A-A' (the axis A-A' visit in FIGS. 1 and 3). The comprises an inner ring 46, an outer ring 48, and a plurality of radial pillars 50 connecting the inner ring 46 and the outer ring 48.

The truss 20 also comprises a crown 52 for fastening to one end 53 of the coil-holder 41 as well as an axial skirt 54 for connecting to a resilient guide ring 56, the outer periphery of which is connected to the fixed frame 12.

The truss 20 is formed by injecting a plastic material into a mold and is therefore in one piece.

The resilient guide ring 56 is commonly referred to as a "spider". It is inserted between the circumferential wall 30 and a free end 57 of the axial skirt 54. It is intended to support the axial skirt 54, and using the latter, a truss assembly 20 and the convex membrane 18, on the fixed frame 12.

The resilient guide ring 56 extends around the axis A-A'. It extends in a radial plane.

The inner and outer rings 46, 48 are coaxial. The outer ring 48 has a larger diameter than the inner ring 46.

The convex membrane 18 is fixed mechanically bearing on the inner and outer rings 46, 48 by gluing.

The outer ring 48 is directly fastened to the peripheral edge 44 of the convex membrane 18.

The radial pillars 50 are angularly distributed around the axis A-A'. They each extend between the outer ring 48 and the fastening crown 52.

The fastening crown 52 has a diameter smaller than that of the inner ring 46.

The fastening crown 52 comprises a receiving groove 58 in which the end 53 of the coil-holder 41 of the moving part 16 is received. The receiving groove 58 is advantageously glued to the coil-holder 41.

The axial skirt 54 is secured to the radial pillars 50. It protrudes from the radial pillars 50 up to the free end 57 and extends axially opposite the inner and outer rings 46, 48. It extends substantially parallel to the axis A-A, and surrounds the latter.

The axial skirt 54 has a diameter comprised between those of the inner and outer rings 46, 48.

The truss 20 has first and second front plates 62, 63 separated by a plane B-B' passing through the axis A-A'. As shown in FIG. 3, the density of radial pillars 50 is greater in the second front plate 63 of the truss 20 than in the first front plate 62 of the truss 20.

The first front plate 62 of the truss 20 also includes at least two conductive strips 64. The conductive strip 64 connects the moving coil 42 of the moving part 16 to an electric supply braid 65. Each conductive strip 64 is received in a radial pillar 50. It passes through this radial pillar 50 and extends into the axial skirt 54.

To that end, and as shown in FIG. 2, in the first front plate 62 of the truss 20, at least one radial pillar 50 comprises an axial slit 66 extending substantially parallel to the axis A-A'. The axial slit 66 comprises a first face 68 oriented away from the axis of the loudspeaker A-A' and a second face 70 oriented toward the axis A-A'. The second face 70 of the axial slit 66 is essentially parallel to the first face 68.

In the first front plate 62 of the truss 20, the axial skirt 54 comprises an axial slit 74 extending substantially parallel to the axis A-A'. The axial slit 74 comprises a first surface 76 oriented away from the axis A-A' and a second surface 78 oriented toward the axis A-A'. The second surface 78 of the axial slit 74 is essentially parallel to the first surface 76.

Figure 4:
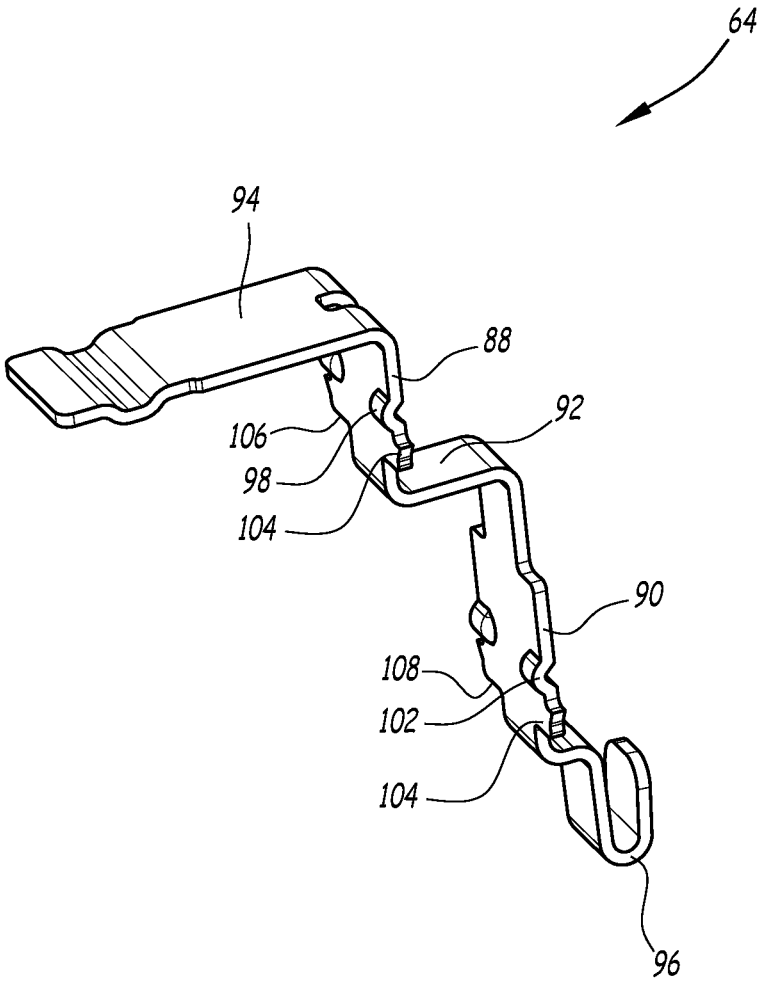
FIG. 4 is a perspective view of a conductive strip according to the invention.
Figure 5:
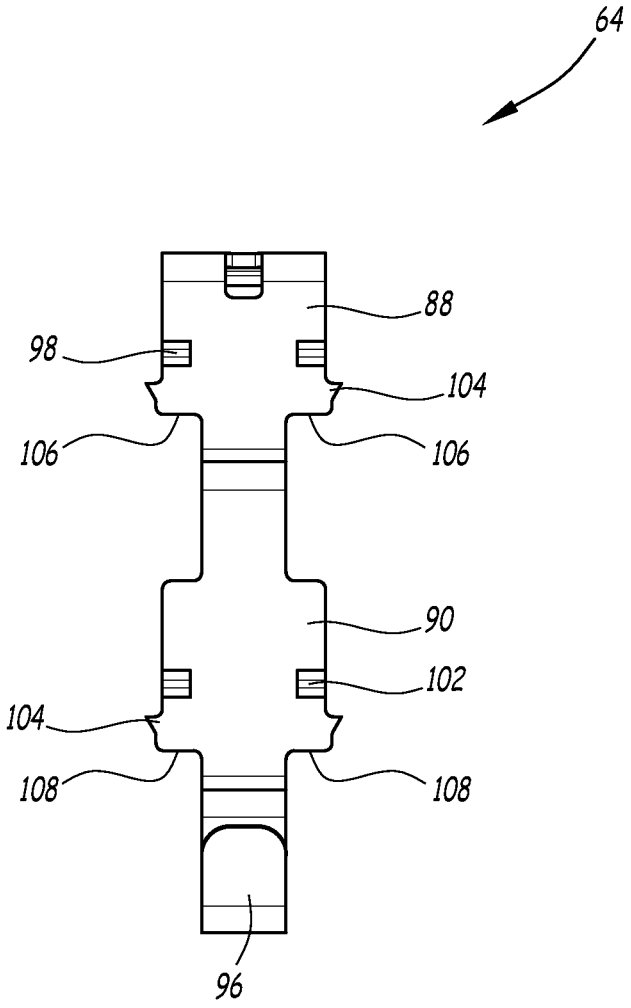
FIG. 5 is a front view of the conductive strip of FIG. 4.

As illustrated in FIGS. 4 and 5, the conductive strip 64 has a thin shape. It is advantageously made from copper.

It has two maintaining segments 88, 90 extending axially connected to one another by a perpendicular radial segment 92. The maintaining segment 88 is extended by a radial connection segment 94, which in turn is connected by welding to a connection tab 95 carried by the coil-holder 41 and extending the moving coil 42.

The maintaining segment 90 is extended by an end lug 96 on which the braid 65 is welded.

The maintaining segments 88, 90 are received in the axial slit 66 and the axial slit 74, respectively.

The maintaining segments 88, 90 each comprise, on their inner face, at least a first protrusion 98, respectively at least a second protrusion 102, bearing on the first face 68 of the axial slit 66, respectively the first surface 76 of the axial slit 74. The outer face of the maintaining segment 88, respectively of the maintaining segment 90, bears on the second face 70 of the axial slit 66, respectively on the second surface 78 of the axial slit 74.

The maintaining segments 88, 90 each also comprise at least one blocking prong 104 configured to penetrate the truss 20 so as to prevent the movement of the conductive strip 64 toward the convex membrane 18 along the axial direction.

The maintaining segment 88 further comprises a shoulder 106 configured to cooperate with the truss 20 so as to prevent the movement of the conductive strip 64 away from the convex membrane 18 along the axial direction.

The blocking prongs 104 and the shoulder 106 therefore jointly block the position of the conductive strip 64 along the axial direction.

The maintaining segment 90 further comprises a shoulder 108 kept at a distance relative to the truss 20, the shoulder 108 and the truss 20 having non-nil play between them substantially equal to 0.8 mm. This play in particular prevents the shoulder 108 from abutting against the truss 20 during any creep of the truss 20 that may cause significant lowering of the conductive strip 64.

The end lug 96 is configured to receive the electric supply braid 65. It advantageously has a U shape converging toward the bottom of the U to maintain the electric supply braid 65.

Figure 6:
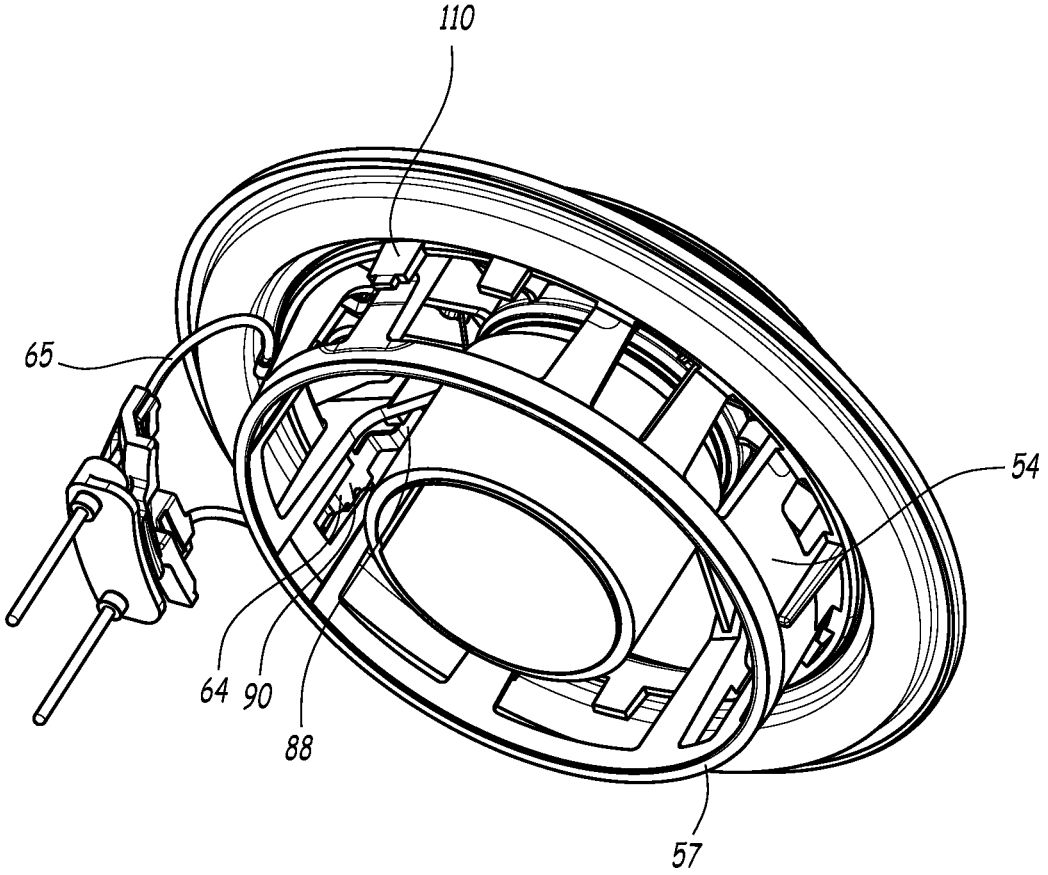
FIG. 6 is a perspective view of the loudspeaker shown in FIG. 1 without the convex membrane and the fixed frame.

The truss 20 comprises, at the base of two radial pillars 50, two stops 110 (one of which is visible in FIG. 6) for temporary blocking of the braids 65 during assembly of the loudspeaker 10. The stops 110 define, with the radial pillars 50, grooves in which the braids 65 are retained during the handling of the moving part 16 equipped with the truss 20 and the convex membrane 18 before they are mounted in the fixed frame 12 of the loudspeaker 10.

In the second front plate 63 of the truss 20, the radial pillars 50 are devoid of axial slit, and the axial skirt 54 is devoid of axial slit. The second front plate 63 of the truss 20 is also devoid of conductive strip 64.

The asymmetrical configuration of the first and second front plates 62, 63 of the truss 20 allows the radial pillars 50 in the first front plate 62 to compensate for the weight of the conductive strips 64 arranged in the first front plate 63. This allows the first and second front plates 62, 63 to have a substantially identical weight so as to obtain a loudspeaker 10 with a good equilibrium property.

The loudspeaker 10 further includes a resilient suspension seal 112 of the convex membrane 18.

The resilient suspension seal 112 connects an upper end of the circumferential wall 30 to the axial skirt 54 in the vicinity of the outer ring 48. The resilient suspension seal 112 is arranged axially less far away from the convex membrane 18 than the resilient guide ring 56.

The resilient suspension seal 112 extends around the axis A-A'. It extends in a radial plane. The resilient suspension seal 112 has, in cross-section along a plane passing through the axis A-A', an Ω shape, the convexity of the Ω facing axially toward the back of the loudspeaker 10.

The resilient suspension seal 112 is airtight.

Owing to the invention described above, a stiffened fastening of the convex membrane 18 makes it possible to reduce the unwanted resonance modes and thus improves the performance of the loudspeaker 10 when the produced sounds have high frequencies.

Furthermore, the conductive strip 64 makes it possible to better maintain the position of the electrical supply braid 65 relative to the moving part 16, which eliminates the need to supply excessively long braids 65 to supply electrical energy to the loudspeaker 10.

The invention claimed is:

1. An electrodynamic loudspeaker, comprising:

a fixed frame, a motor including a fixed base connected to the fixed frame and a movable part axially movable relative to the fixed base along an axis, a convex membrane, the convexity of which is oriented toward the outside of the loudspeaker, and a truss connecting the convex membrane and the moving part, wherein the truss comprises an inner ring and an outer ring that are coaxial, connected to one another by radial pillars and a fastening crown for fastening to one end of the moving part, the convex membrane being fastened bearing on the inner and outer rings; and wherein the fastening crown comprises a receiving groove for receiving the end of the moving part, the moving part advantageously being glued to the receiving groove.

2. The electrodynamic loudspeaker according to claim 1, wherein the convex membrane has a peripheral edge, the outer ring being directly fastened to the peripheral edge of the convex membrane.

3. The electromagnetic loudspeaker according to claim 1, wherein the truss comprises an axial skirt secured to the radial pillars and extending axially opposite the inner and outer rings.

4. The electromagnetic loudspeaker according to claim 1, wherein the truss has first and second front plates, each extending over 180° around the axis, the first front plate of the truss further including at least one conductive strip connecting the moving part to an electrical supply braid, the second front plate of the truss being devoid of such a conductive strip.

5. The electromagnetic loudspeaker according to claim 4, wherein the conductive strip comprises an end lug configured to receive the electrical supply braid.

6. The electromagnetic loudspeaker according to claim 4, wherein the conductive strip is received between two essentially parallel faces of the truss and in that the conductive strip comprises, on an inner face, a protrusion bearing against one of the faces of the truss, the conductive strip bearing on the other truss face along its other face.

7. The electromagnetic loudspeaker according to claim 4, wherein the conductive strip comprises at least one blocking prong configured to penetrate the truss so as to prevent the movement of the conductive strip away from the convex membrane along the direction of the axis of the loudspeaker.

8. The electromagnetic loudspeaker according to claim 4, wherein the radial pillars are angularly distributed and in that the density of radial pillars is greater in the second front plate of the truss than in the first front plate of the truss.

9. The electromagnetic loudspeaker according to claim 3, including a resilient guide ring inserted between the fixed frame and a free end of the axial skirt.

* * * * *